US010139081B2

(12) United States Patent
Bukkems et al.

(10) Patent No.: US 10,139,081 B2
(45) Date of Patent: Nov. 27, 2018

(54) LIGHTING MODULE AND A LUMINAIRE

(71) Applicant: PHILIPS LIGHTING HOLDING B.V., Eindhoven (NL)

(72) Inventors: Peter Johannes Martinus Bukkems, Eindhoven (NL); Johannes Petrus Maria Ansems, Eindhoven (NL); Johannes Gerrit Jan Beijer, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/652,275

(22) Filed: Jul. 18, 2017

(65) Prior Publication Data

US 2018/0031208 A1 Feb. 1, 2018

(30) Foreign Application Priority Data

Jul. 29, 2016 (EP) ..... 16181856

(51) Int. Cl.

| | |
|---|---|
| ***F21V 14/02*** | (2006.01) |
| ***F21V 19/02*** | (2006.01) |
| ***F21V 3/02*** | (2006.01) |
| ***F21V 7/00*** | (2006.01) |
| ***F21K 9/65*** | (2016.01) |

(Continued)

(52) U.S. Cl.

CPC ..... *F21V 14/02* (2013.01); *F21K 9/65* (2016.08); *F21V 3/02* (2013.01); *F21V 7/0008* (2013.01); *F21V 7/0016* (2013.01); *F21V 19/02* (2013.01); *F21K 9/23* (2016.08); *F21S 8/086* (2013.01); *F21Y 2107/50* (2016.08); *F21Y 2107/90* (2016.08); *F21Y 2115/10* (2016.08)

(58) Field of Classification Search

CPC ..... F21V 14/02; F21V 7/0016; F21V 19/02; F21Y 2107/50; F21Y 2107/90; F21K 9/65; F21K 9/23; F21S 8/086

See application file for complete search history.

(56) References Cited

U.S. PATENT DOCUMENTS 5,463,280 A * 10/1995 Johnson ..... F21V 3/00 315/187
5,749,646 A * 5/1998 Brittell ..... F21S 10/02 362/231

(Continued)

FOREIGN PATENT DOCUMENTS

CA 2569853 A1 * 12/2005 ..... B60Q 1/2611
CN 202532239 U 11/2012

(Continued)

*Primary Examiner* — Alexander Garlen

(57) ABSTRACT

The invention provides a lighting module for use in a reflector which comprises at least one first light source emitting first light having a first light distribution with a first main direction and at least one second light source emitting second light having a second light distribution with a second main direction opposite to the first main direction. A base connects the lighting module to a luminaire socket. The base has a longitudinal axis extending from the base. The first light source is positioned on the longitudinal axis and the second light source is positioned at a non-zero distance to the longitudinal axis. The first main direction and the second main direction are substantially perpendicular with respect to the longitudinal axis.

14 Claims, 7 Drawing Sheets

(51) Int. Cl.

| | |
|---|---|
| *F21K 9/23* | (2016.01) |
| *F21S 8/08* | (2006.01) |
| *F21Y 115/10* | (2016.01) |
| *F21Y 107/50* | (2016.01) |
| *F21Y 107/90* | (2016.01) |

(56) References Cited

U.S. PATENT DOCUMENTS

| | | | | |
|---|---|---|---|---|
| 7,086,756 | B2 * | 8/2006 | Maxik | F21K 9/90 362/249.04 |
| 8,845,132 | B2 | 9/2014 | Flaherty et al. | |
| 2005/0068787 | A1 | 3/2005 | Ishida | |
| 2012/0026732 | A1 * | 2/2012 | Fricke | F21V 14/02 362/231 |
| 2012/0182711 | A1 * | 7/2012 | Kolodin | F21K 9/232 362/84 |
| 2012/0287653 | A1 * | 11/2012 | Chen | F21V 29/004 362/430 |
| 2014/0191647 | A1 | 7/2014 | Ter Weeme et al. | |
| 2014/0362568 | A1 * | 12/2014 | Su | F21K 9/232 362/235 |

FOREIGN PATENT DOCUMENTS

| | | | |
|---|---|---|---|
| TW | 201120369 | A | 6/2011 |
| WO | WO2007088665 | A1 | 8/2007 |
| WO | WO2015032896 | A1 | 3/2015 |

* cited by examiner

LIGHTING MODULE AND A LUMINAIRE

FIELD OF THE INVENTION

The present invention relates to a lighting module for use in a reflector which may be based on solid state lighting (SSL) technology, and to a luminaire comprising the lighting module.

BACKGROUND OF THE INVENTION

U.S. Pat. No. 8,845,132B2 discloses an LED-based lamp assembly with a driver assembly having a base portion rotatably engageable with the socket of a light fixture to make a first electrical contact with the light fixture. The driver assembly has an electrically conductive, retractable tip portion coupled to the base portion which makes a second electrical contact with the light fixture. The tip portion retracts relative to the base when in electrical contact with the light fixture's socket portion. A lamp housing assembly operably connected to the driver assembly has a lamp housing connected to the driver assembly. The lamp housing is coupled to at least one substrate having at least one LED light thereon. The substrate is connected to, or is an integral part of, a heat sink that carries heat away from the substrate and/or LED light. The lamp housing assembly is rotatable relative to the light fixture to adjust the angular position of the light source.

SUMMARY OF THE INVENTION

In view of the above, a concern of the present invention is to provide a lighting module which allows for achieving a direct replacement of a conventional high brightness filament or arc lamp. For example, the invention describes a lighting module which enables to replace a conventional high pressure sodium lamp without modification of the associated luminaire.

To address this concern, a lighting module in accordance with the independent claim is provided. Preferred embodiments are defined by the dependent claims.

According to a first aspect of the invention, a lighting module is provided comprising at least one first light source configured to emit first light having a first light distribution with a first main direction, at least one second light source configured to emit second light having a second light distribution with a second main direction opposite to the first main direction, a base for connecting the lighting module to a luminaire socket and having a longitudinal axis LA, the first light source being positioned on the longitudinal axis and the second light source being positioned at a non-zero distance to the longitudinal axis, wherein the first main direction and the second main direction are substantially perpendicular with respect to the longitudinal axis.

Hence, the invention provides a lighting module that is able to provide a direct replacement for a conventional high brightness filament or arc lamp, such as a high pressure sodium lamp, without modification of a luminaire. The reason is that instead of a single high brightness arc or filament, two light sources which may be LEDs are used. The first LED light source is positioned in the optical center of and directed towards a reflector and provides first light having a first light distribution. The reflector collects and redirects the first light having a first light distribution into reflected first light. The second LED light source is not positioned in the optical center of the reflector, but at a distance to the first LED light source enabling sufficient cooling of both LED light sources, and provides second light having a second light distribution in a direction away from the reflector. The effect is that the reflected first light and the second light are combined to mimic or resemble as much as possible light of a conventional high brightness filament or arc lamp positioned with respect to the reflector of the luminaire. The reflector may be part of the lighting module or may be mechanically separated from the lighting module as a part of the luminaire. The construction of the lighting module in accordance with the invention enables the proper use with such an existing reflector.

The solution proposed in U.S. Pat. No. 8,845,132B2 is unable to provide a direct replacement for a conventional high brightness lamp, such as a high pressure sodium lamp. The reason is that a conventional high brightness filament or arc lamp produces generally a high brightness filament or arc shape source of light, which is efficiently collected and collimated by a reflector due to its particular position with respect to the reflector, e.g. of a luminaire. The solution proposed in U.S. Pat. No. 8,845,132B2 does not provide a high brightness filament or arc shape source providing light that is efficiently collected and collimated by a reflector of a luminaire because the LEDs are not at the mentioned particular position with respect to the reflector. None of the LEDs are positioned on the longitudinal axis of the base. Thus, the construction of U.S. Pat. No. 8,845,132B2 does not provide a direct replacement for a conventional high brightness filament or arc lamp, such as a high pressure sodium lamp.

In an embodiment, the lighting module further comprises a carrier carrying said first light source and said second light source, wherein the carrier is attached to said base and comprises a rotation mechanism for rotating the first light source and the second light source with respect to the longitudinal axis wherein the first light source is kept on the longitudinal axis. The rotation mechanism allows that the first light source may be positioned in the first main direction to a reflector of a luminaire, while the second light source may be positioned in the second main direction opposite to the reflector of the luminaire. Thus the reflector of the luminaire is reflecting and collimating the first light. The obtained effect is that the first light distribution is at least partly overlapping the second light distribution. In this way, the illuminance (i.e. the total luminous flux incident on a surface per unit area e.g. on a road) is increased in an effective and efficient way.

In another embodiment, the carrier comprises a heat spreading member carrying the first light source and the second light source. The heat spreader is a heat sink formed from thermally conductive material such as a metal e.g. copper or aluminum. The heat spreader might also comprise a heat pipe. A heat pipe is a heat-transfer device that combines the principles of both thermal conductivity and phase transition to efficiently manage the transfer of heat between two solid interfaces. The obtained effect is that the first light source and the second light source are cooled by the heat sink or heat pipe in an effective and efficient way.

In yet another embodiment, the heat spreading member has a first surface carrying said first light source and a second surface carrying said second light source. The distance between the first light source and second light source defines the thickness T of the heat spreading member. The first surface and the second surface have a width W at the position of the first light source and the second light source. The width W extends perpendicular to the longitudinal axis and perpendicular to thickness T and wherein the thickness T is at least two times the width W. More preferably, the thickness T is at least three times the width W. Most preferably, the thickness T is at least four times the width W. Increasing thickness T improves cooling of the first light source and second light source. Decreasing the width W improves collimated light transmission of the light being reflected by the reflector of the luminaire.

In yet another embodiment, the thickness T is in the range from 5 mm to 100 mm. More preferably, the thickness T is in the range from 5 mm to 50 mm. Most preferably, the thickness T is in the range from 5 mm to 30 mm. Increasing thickness T improves cooling of the first light source and second light source.

In yet another embodiment, the width W is in the range from 1 mm to 30 mm. More preferably, the width W is in the range from 1 mm to 20 mm. Most preferably, the width W is in the range from 1 mm to 15 mm. Decreasing the width W improves collimated light transmission of the light being reflected by the reflector of the luminaire.

In yet another embodiment, the lighting module comprises an at least partially light transmitting envelope enclosing at least the first light source and the second light source. The obtained effect is that the first light source and the second light source are protected against ingress. The envelope is preferably clear i.e. not translucent. The obtained effect is that light is not redirected to other directions and maintains its collimation achieved by the reflector of the luminaire.

In yet another embodiment, the first light source comprises a plurality of light emitting diodes arranged in a first light emitting diode array extending in the direction of the longitudinal axis. The obtained effect is increased lumen output of the lighting module, while the plurality of LEDs is positioned at the longitudinal axis.

In yet another embodiment, the second light source comprises a plurality of light emitting diodes arranged in a second light emitting diode array extending in the direction of the longitudinal axis. The obtained effect is increased lumen output of the lighting module.

In yet another embodiment, the first light emitting diode array comprises at least a first light emitting diode row configured to emit first light emitting diode row light in a third main direction and at least a second light emitting diode row configured to emit second light emitting diode row light in a fourth main direction. The combined first light emitting diode row light and the second light emitting diode row light provides the first light in the first main direction. The obtained effect is increased lumen output of the lighting module.

In yet another embodiment, the second light emitting diode array comprises at least a third light emitting diode row configured to emit third light emitting diode row light in a fifth main direction and at least a fourth light emitting diode row configured to emit sixth light emitting diode row light in a sixth main direction. The combined third light emitting diode row light and fourth light emitting diode row light provides the second light in the second main direction. The obtained effect is increased lumen output of the lighting module.

In yet another embodiment, the angle θ between the first light emitting diode row and the second light emitting diode row and an angle between the third light emitting diode row and the fourth light emitting diode row is in the range from 60 to 300 degrees. More preferably, the angle θ is in the range from 90 to 270 degrees. Most preferably, the angle θ is in the range from 120 to 240 degrees. The obtained effect is increased lumen output of the lighting module at decreased width W.

In yet another embodiment, the first light source and/or the second light source comprises an optical element. The optical element is positioned in the optical path of the first light or the second light and is configured for collimating the first light or the second light. The optical element may use the principle of refraction, diffraction, reflection or scattering. The optical element may, for example, be a reflector or total internal reflective (TIR) element. The obtained effect is pre-collimated light.

In yet another embodiment, the lighting module comprises a reflector. The reflector is being positioned for reflecting the first light. The obtained effect is that the first light distribution is at least partly overlapping the second light distribution. Preferably, the overlap of the first light distribution and the second light distribution is maximal.

In yet another embodiment, the lighting module is positioned in a luminaire. The luminaire comprises a reflector being positioned for reflecting the first light. The obtained effect is that the first light distribution is at least partly overlapping the second light distribution. Preferably, the overlap of the first light distribution and the second light distribution is maximal.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

The same features having the same function in different figures are referred to the same references.

DETAILED DESCRIPTION OF THE EMBODIMENTS

Figure 1A:
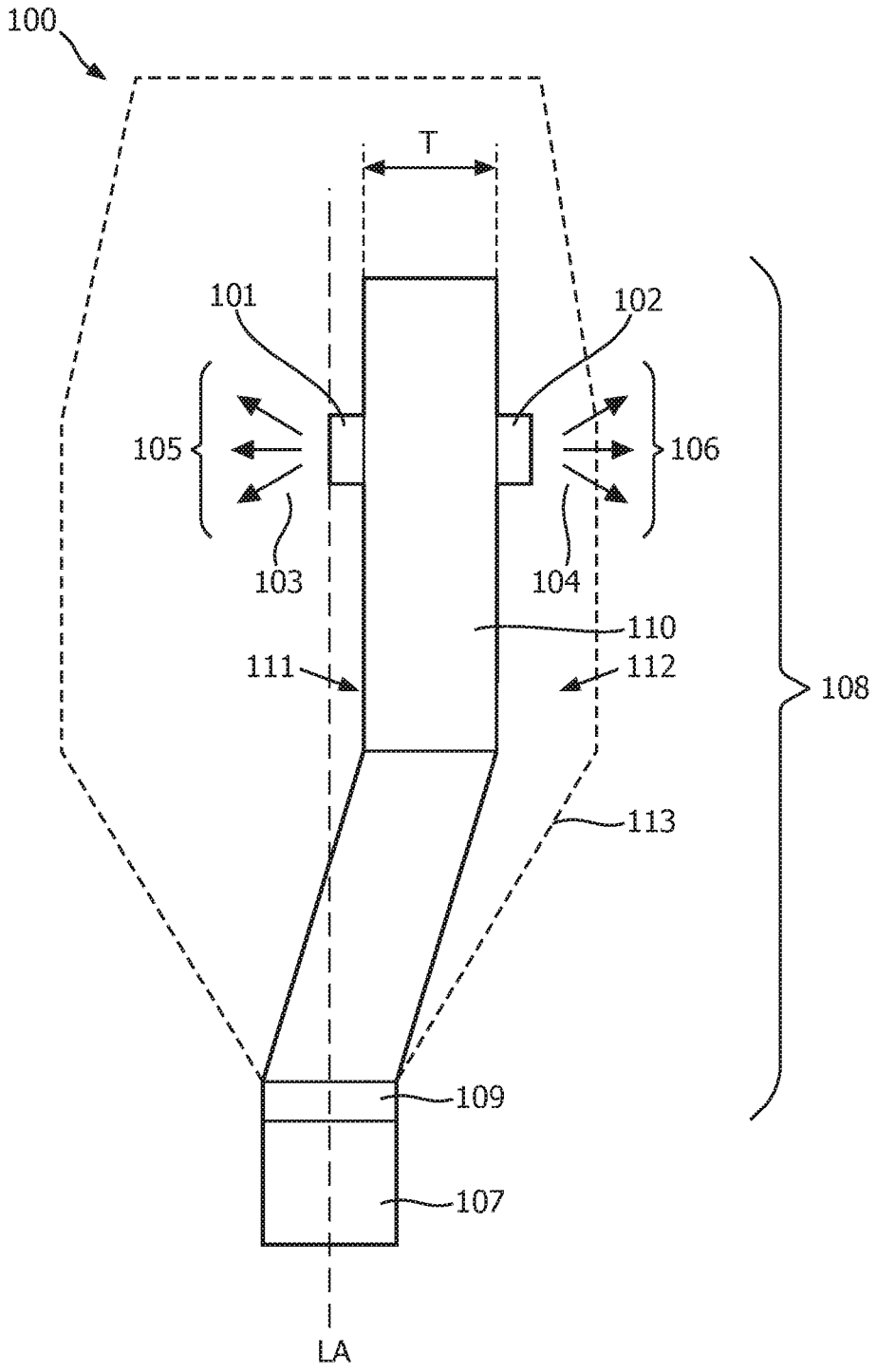
FIGS. 1*a* and 1*b* schematically depict a side view and a front view, respectively, of a lighting module according to an embodiment of the present invention.
Figure 1B:
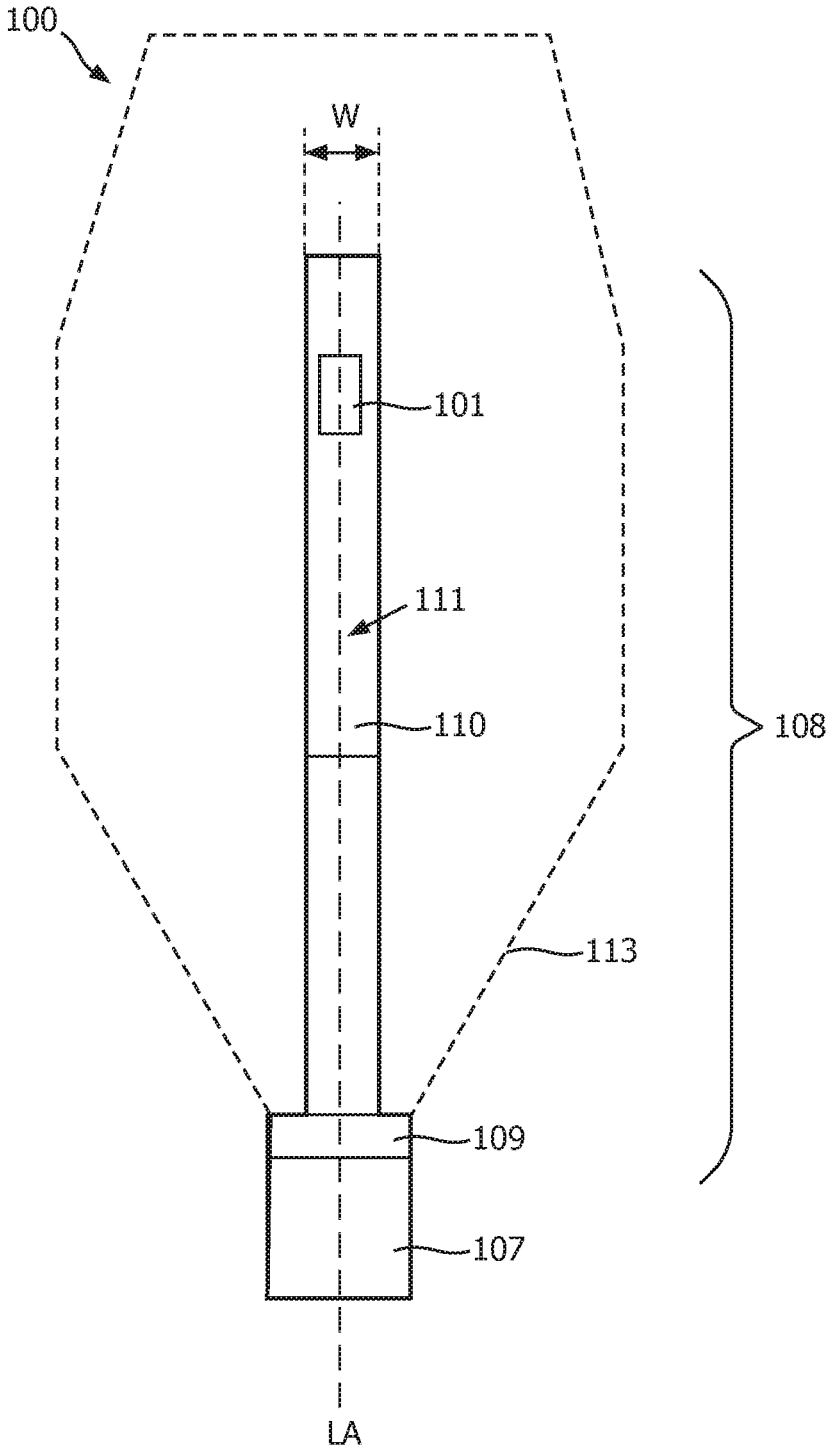

FIGS. 1*a* and 1*b* schematically depict a side view and a front view, respectively, of a lighting module 100 according to an embodiment of the present invention. The lighting module 100 comprises at least one first light source 101 emitting first light 103 having a first light distribution 105 with a first main direction, and at least one second light source 102 emitting second light 104 having a second light distribution 106 with a second main direction opposite to the first main direction. The lighting module 100 further comprises a base 107 to connect the lighting module 100 to a luminaire socket (not shown in FIGS. 1*a* and 1*b*). The base 107 has a longitudinal axis LA. The first light source 101 is positioned on the longitudinal axis LA and the second light source 102 is positioned at a non-zero distance to the longitudinal axis LA. The first main direction and the second main direction are perpendicular with respect to the longitudinal axis LA.

The first light source 101 and the second light source 102 may, for example, comprise a LED or laser light source or the combination thereof.

The base is, for example, made from a metal. The base is, for example, a cap such as an Edison screw or a bayonet mount. Other examples of caps include but are not limited to E5 (5 mm base diameter), E10 (10 mm base diameter), E11 (11 mm base diameter), E12 (12 mm base diameter), E14 (14 mm base diameter), E17 (17 mm base diameter), E26 (26 mm base diameter), E27 (27 mm base diameter), E29 (29 mm base diameter), E39 (39 mm base diameter), or E40 (40 mm base diameter). The lighting module may comprise two bases i.e. a first base and a second base. For example, the first base may be positioned at the first end of the lighting module and the second base may be positioned the second end, opposite to the first end, of the lighting module. The longitudinal axis LA extends for the first base to the second base. The base 107 is preferably round such that it fits a round opening of a tube or round opening of an envelope.

The lighting module 100 may further comprise a carrier 108 carrying said first light source 101 and said second light source 102, wherein the carrier 108 is attached to said base 107 and comprises a rotation mechanism 109 for rotating the first light source 101 and the second light source 102 with respect to the longitudinal axis LA. The rotation mechanism 109 allows the first light source 101 which is positioned in the optical center to produce the first light distribution 105 with the first main direction towards a reflector of a luminaire (not shown). The second light source 102 is positioned away from the optical center to produce the second light distribution 106 with the second main direction opposite to the reflector of the luminaire. Thus the reflector of the luminaire is reflecting and collimating the first light 103. The obtained effect is that the first light distribution 105 after reflection is at least partly overlapping the second light distribution 106 wherein the combined light is provided in the second main direction. In this way, the illuminance is increased in an effective and efficient way. Consequently, the construction of the lighting module 100 is such that an existing lamp in an existing luminaire with existing reflector can be replaced without any modification to this luminaire.

The rotation mechanism 109 may, for example as disclosed in WO2016012330, comprises a first part and a second part. The second part is overlapping the first part. The first is provided with a notch. The second part is provided with a guiding slot. The notch protrudes into the guiding slot and is movable along the guiding slot so as to allow for rotating the first light source 101 and the second light source 102 with respect to the longitudinal axis LA. The guiding slot may extend for about 180 degrees. The rotation mechanism 109 may also be based on any other rotating principle known in the prior art. The rotation mechanism 109 may further comprise a fastener and/or a locking means for fixing the orientation of the first light source 101 and the second light source 102 with respect to a reflector e.g. of a luminaire. Thus, for example, the carrier comprises a first part and a second part. The first part is rotatably mounted with respect to the second part. The first part can be fixed to the second part by the fastener or locking construction. For example, the first part can be fixed to the second part by using a screw, pin or any other known manner.

The carrier 108 may further comprise a heat spreading member 110 carrying the first light source 101 and the second light source 102. The heat spreader member 110 may be a heat sink formed from thermally conductive material such as a metal selected from the group consisting of aluminum, aluminum alloy, magnesium, copper, gold, and silver, preferably aluminum and/or copper. The heat spreader member 110 may also comprise a heat pipe. A heat pipe is a heat-transfer device that combines the principles of both thermal conductivity and phase transition to efficiently manage the transfer of heat between two solid interfaces. The thermal conductivity of the heat spreading member 110 is preferably at least 40 $W \cdot m^{-1} \cdot K^{-1}$, more preferably at least 80 $W \cdot m^{-1} \cdot K^{-1}$, and most preferably at least 100 $W \cdot m^{-1} \cdot K^{-1}$. For example, the thermal conductivity of the heat spreading member 110 made of aluminum is about 200 $W \cdot m^{-1} \cdot K^{-1}$. The thermal conductivity of the heat spreading member 110 made of copper is about 400 $W \cdot m^{-1} \cdot K^{-1}$. A heat pipe has typically even a higher thermal conductivity with respect to aluminum and copper. Use of thermally conductive material with a relatively high thermal conductivity may enhance heat dissipation, wherein higher values of thermal conductivity may provide higher levels of heat dissipation. The obtained effect is that the first light source 101 and the second light source 102 are cooled by the heat sink or heat pipe in an effective and efficient way.

The heat spreading member 110 has a first surface 111 carrying said first light source 101 and a second surface 112 carrying said second light source 102. The distance between the first surface 111 and the second surface 112 defines the thickness T of the heat spreading member 110. The first surface 111 and the second surface 112 have a width W (see FIG. 1*b*) at the position of the first light source 101 and the second light source 102. The width W extends perpendicular to the longitudinal axis LA and perpendicular to thickness T and wherein the thickness T is at least two times the width W. More preferably, the thickness T is at least three times the width W. Most preferably, the thickness T is at least four times the width W. Increasing thickness T improves cooling of the first light source 101 and second light source 102. Decreasing the width W improves collimated light transmission of the light being reflected by the reflector of the luminaire.

In yet another embodiment, the thickness T is preferably in the range from 3 mm to 100 mm. More preferably, the thickness T is in the range from 3 mm to 50 mm. Most preferably, the thickness T is in the range from 3 mm to 30 mm.

In yet another embodiment, the width W is preferably in the range from 1 mm to 30 mm. More preferably, the width W is in the range from 1 mm to 20 mm. Most preferably, the width W is in the range from 1 mm to 15 mm.

The lighting module 100 may further comprise an at least partially light transmitting envelope 113 enclosing at least the first light source 101 and the second light source 102. The obtained effect is that the first light source 101 and the second light source 102 are protected against ingress. The envelope 113 is preferably clear i.e. not translucent (i.e. does not comprise a light scattering coating/layer). The obtained effect is that light is not redirected to other directions and maintains its collimation achieved by the reflector of the luminaire. The center of the light transmitting envelope 113 of the lighting module 100 is positioned along the longitudinal axis LA relative to the base 107. The light transmitting envelope 113 can be made of glass or plastics, for instance. In an example, the light transmitting envelope 113 has a pear like shape formed by a round head portion and a circular cylindrical neck portion. The head portion may also be elongated.

The envelope is, for example, made from soft glass, hard glass, quartz glass or thermal resistant plastic. The envelope is transparent and, preferably, non-scattering.

Figure 2:
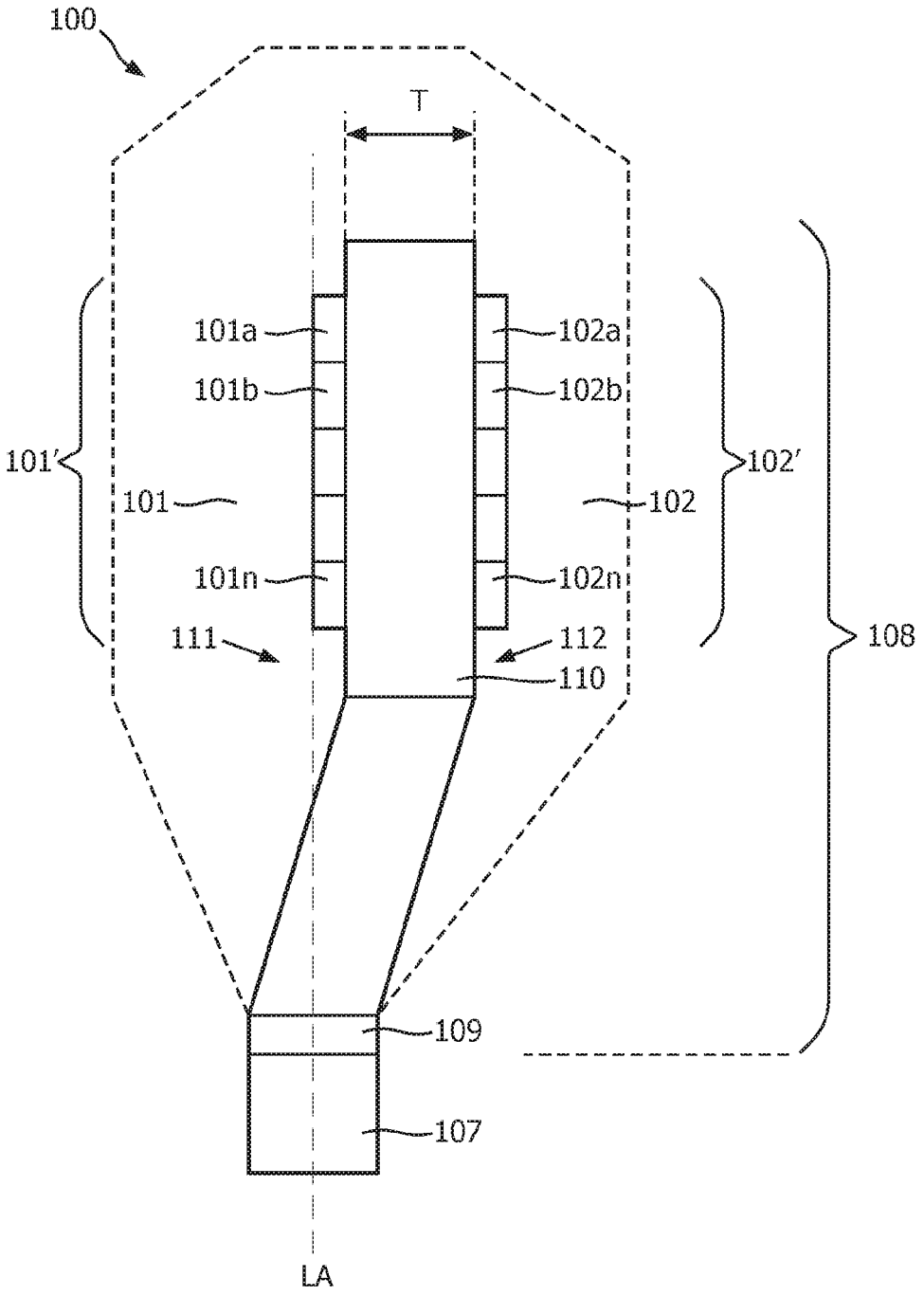
FIG. 2 schematically depicts a side view of the lighting module according to another embodiment of the present invention.

FIG. 2 schematically depicts a side view of the lighting module 100 according to another embodiment of the present invention. As indicated in FIG. 2, the first light source 101 may comprise a plurality of light emitting diodes 101*a*, 101*b*, . . . , 101*n* arranged in a first light emitting diode array 101' extending in the direction of the longitudinal axis LA. The obtained effect is increased lumen output of the lighting module 100. The light emitting diode array is preferably a linear light emitting diode array. The linear light emitting diode array may comprise more LEDs in a first light emitting diode array direction than LEDs in a second light emitting diode array direction perpendicular to the first light emitting diode array direction. The first light emitting diode array direction is preferably parallel to the axis LA.

In yet another embodiment, the second light source 102 may comprise a plurality of light emitting diodes 102*a*, 102*b*, . . . , 102*n* arranged in a second light emitting diode array 102' extending in the direction of the longitudinal axis LA. The obtained effect is increased lumen output of the lighting module 100.

In another embodiment, both the first light source 101 and the second light source 102 comprise a plurality of light emitting diodes. In other words, the first light source 101 may comprise a plurality of light emitting diodes 101*a*, 101*b*, . . . , 101*n* arranged in a first light emitting diode array 101' extending in the direction of the longitudinal axis LA and the second light source 102 may comprise a plurality of light emitting diodes 102*a*, 102*b*, . . . , 102*n* arranged in a second light emitting diode array 102' extending in the direction of the longitudinal axis LA.

Figure 3C:
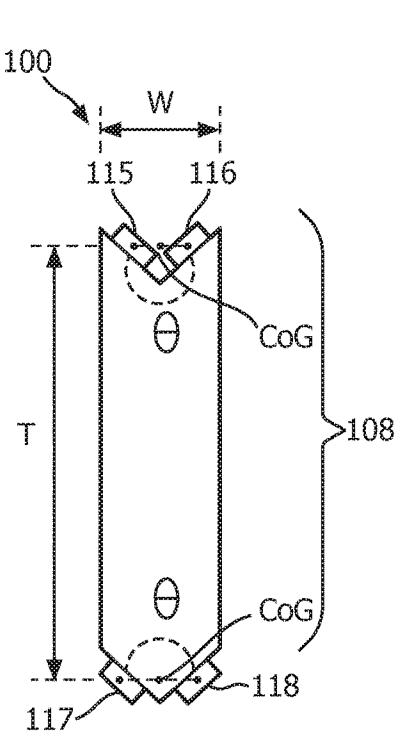
FIGS. 3*a* to 3*c* schematically depict cross sections of a lighting module according to another embodiment of the present invention.
Figure 3B:
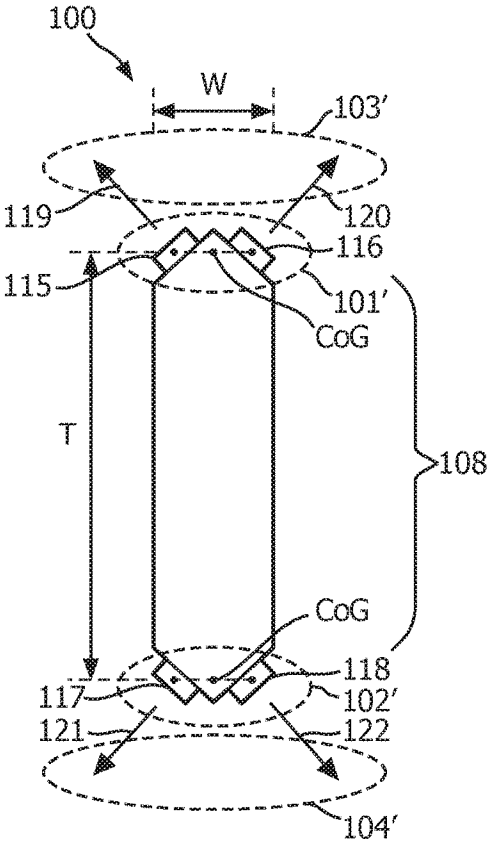
Figure 3A:
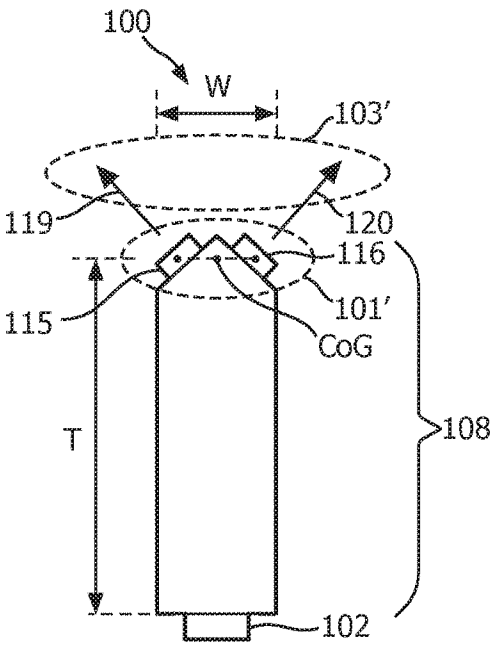

FIGS. 3*a* to 3*c* schematically depict cross sections of the lighting module 100 according to another embodiment of the present invention. As indicated in FIG. 3*a*, the first light emitting diode array 101' comprises at least a first light emitting diode row 115 which emits first light emitting diode row light 119 in a third main direction and at least a second light emitting diode row 116 configured to emit second light emitting diode row light 120 in a fourth main direction. The combined first light emitting diode row light 119 and the second light emitting diode row light 120 provides the first light in the first main direction. Thus the first light source 101 comprises the first light emitting diode array 101'. Although the first light emitting diode row 119 and second light emitting diode row 120 may not anymore precisely positioned on the longitudinal axis LA, the center of gravity CoG of the first light emitting diode row 119 and second light emitting diode row 120, which is earlier referred to the first light source, is positioned on the longitudinal axis LA. Thus the center of gravity of the light emitting diodes may be located where no light source is positioned. The wording "the first light source being positioned on the longitudinal axis LA" should be interpreted as that the center of gravity of the first light emitting diode row 119 and the second light emitting diode row light 120 is positioned on the longitudinal axis LA. The center of gravity of the light emitting diode 101*a* and the light emitting diode 102*a* is the center point between both light emitting diodes. In case of a first light emitting diode row 119 and second light emitting diode row 120 the center of gravity follows a line. The line crosses the center of gravity of the light emitting diode 101*a* and the light emitting diode 102*a*, but also the center of gravity of the light emitting diode 101*b* and the light emitting diode 102*b*, etc. The obtained effect is increased lumen output of the lighting module 100. It goes without saying that the light emitting diode array may comprise more than two light emitting diode rows. For example, the light emitting diode array may comprise three light emitting diode rows. In a preferred embodiment, the center of gravity is a center of symmetry (as illustrated in FIGS. 3*a* to 3*c*). It goes without saying that the LEDs are positioned close to each other. The gap (i.e. distance between the two neighboring LEDs, e.g. light emitting diode 101*a* and light emitting diode 102*a*) is preferably below 1 mm, more preferably below 0.8, most preferably below 0.7 mm.

Any type of light emitting diode may be used. For example, top emitters might be used which provide a Lambertian light distribution. Chip-scale package (CSP) LEDs might be used as well. CSP LEDs provide more light to the sides. The obtained effect is that the overlap of the first light emitting diode row light 119 and the second light emitting diode row light 120 is maximal.

In yet another embodiment, as indicated in FIG. 3*b*, the second light emitting diode array 102 comprises at least a third light emitting diode row 117 configured to emit third light emitting diode row light 121 in a fifth main direction and at least a fourth light emitting diode row 118 configured to emit sixth light emitting diode row light 122 in a sixth main direction. The combined third light emitting diode row light 121 and fourth light emitting diode row light 122 provides the second light in the second main direction. Thus the second light source 102 comprises the second light emitting diode array 102'. The obtained effect is increased lumen output of the lighting module 100.

In yet another embodiment, as indicated in FIG. 3*c*, the angle θ between the first light emitting diode row 115 and the second light emitting diode row 116 and an angle between the third light emitting diode row 117 and the fourth light emitting diode row 118 is in the range from 60 to 300 degrees. More preferably, the angle θ is in the range from 90 to 270 degrees. Most preferably, the angle θ is in the range from 120 to 240 degrees. The obtained effect is increased lumen output of the lighting module 100 at decreased width W.

It goes without saying that the first light source 101 and/or second light source 102 may comprise more than two light emitting diode rows. For example, the first light source 101 may comprise three light emitting diode rows.

Figure 4:
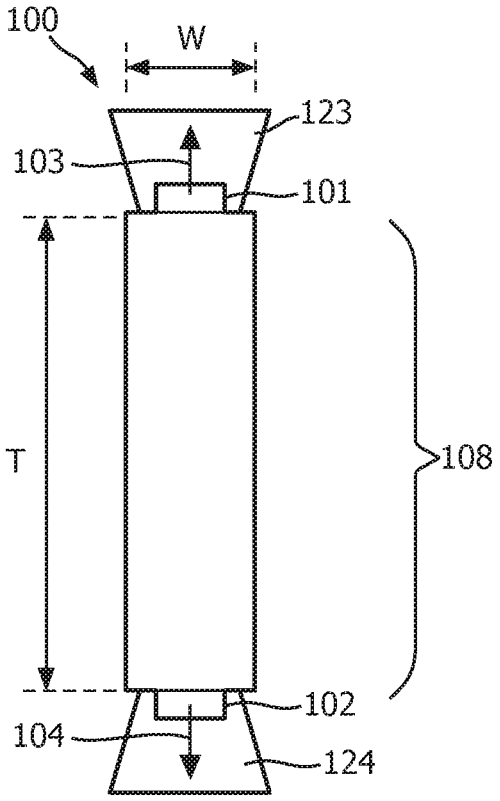
FIG. 4 schematically depicts a cross section of a lighting module according to another embodiment of the present invention.

FIG. 4 schematically depicts a cross section of the lighting module 100 according to another embodiment of the present invention. The first light source 101 may comprise a first optical element 123. The second light source 102 may comprise a second optical element 124. The first optical element 123 and second optical element 124 are positioned in the optical path of the first light 103 and the second light 104 and is configured for collimating the first light 103 and the second light 104. The optical elements may use the principle of refraction, diffraction, reflection or scattering. The optical element may, for example, be a reflector or a total internal reflective (TIR) element. The obtained effect is pre-collimated light.

Figure 5:
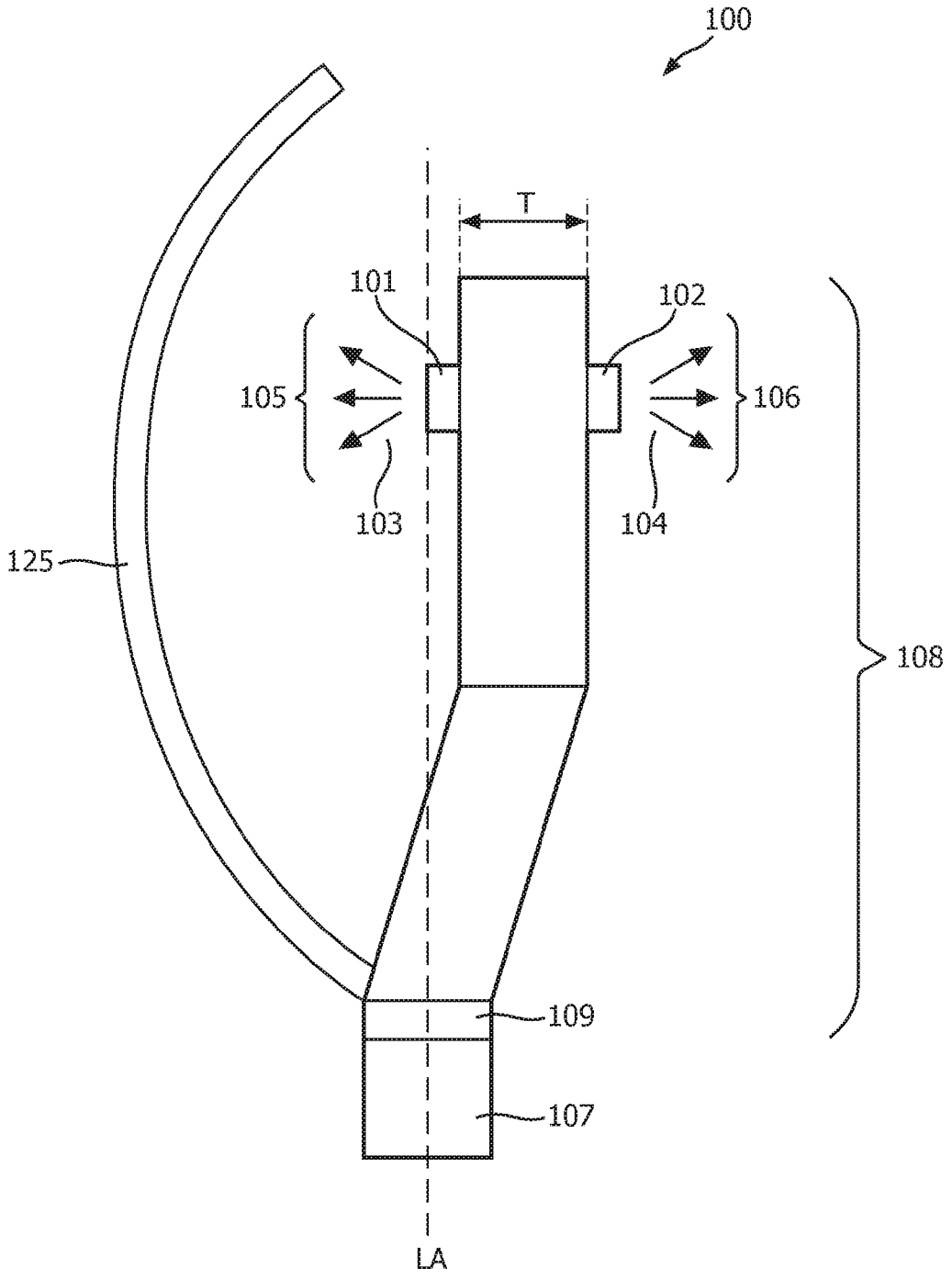
FIG. 5 schematically depicts a side view of a lighting module according to another embodiment of the present invention, and FIG. 6 schematically depicts the use of the lighting module in a luminaire.

FIG. 5 schematically depicts a side view of a lighting module 100 according to another embodiment of the present invention. The lighting module 100 comprises a reflector 125. The reflector 125 is being positioned for reflecting the first light 103 of the first light source 101. The obtained effect is that the first light distribution 105 is at least partly overlapping the second light distribution 106. Preferably, the overlap of the first light distribution 105 and the second light distribution 106 is maximal.

In a lighting module 100 in which the reflector 125 is present, the longitudinal axis LA extends in the optical center OC of the reflector 125. In other words, in this embodiment, the lighting module 100 comprises the reflector 125 with an optical center OC, at least one first light source 101 configured to emit first light 103 having a first light distribution 105, at least one second light source 102 configured to emit second light 104 having a second light distribution 106, a base 107 for connecting the lighting module 100 to a luminaire socket, an longitudinal axis LA extending from the base 107 and being positioned in the optical center OC, the first light source 101 being positioned on the longitudinal axis LA to obtain the first light distribution 105 being directed towards the reflector 125 and the second light source 102 being positioned at a non-zero distance to the longitudinal axis LA to obtain the second light distribution 106 being directed away from the reflector 125.

In an embodiment, the reflector 125 is positioned with respect to the first light source 101 such that the first light source 101 is positioned in the optical center OC of the reflector 125. The optical center (OC) is not limited to the longitudinal axis LA but may comprise an area around the longitudinal axis LA.

Figure 6:
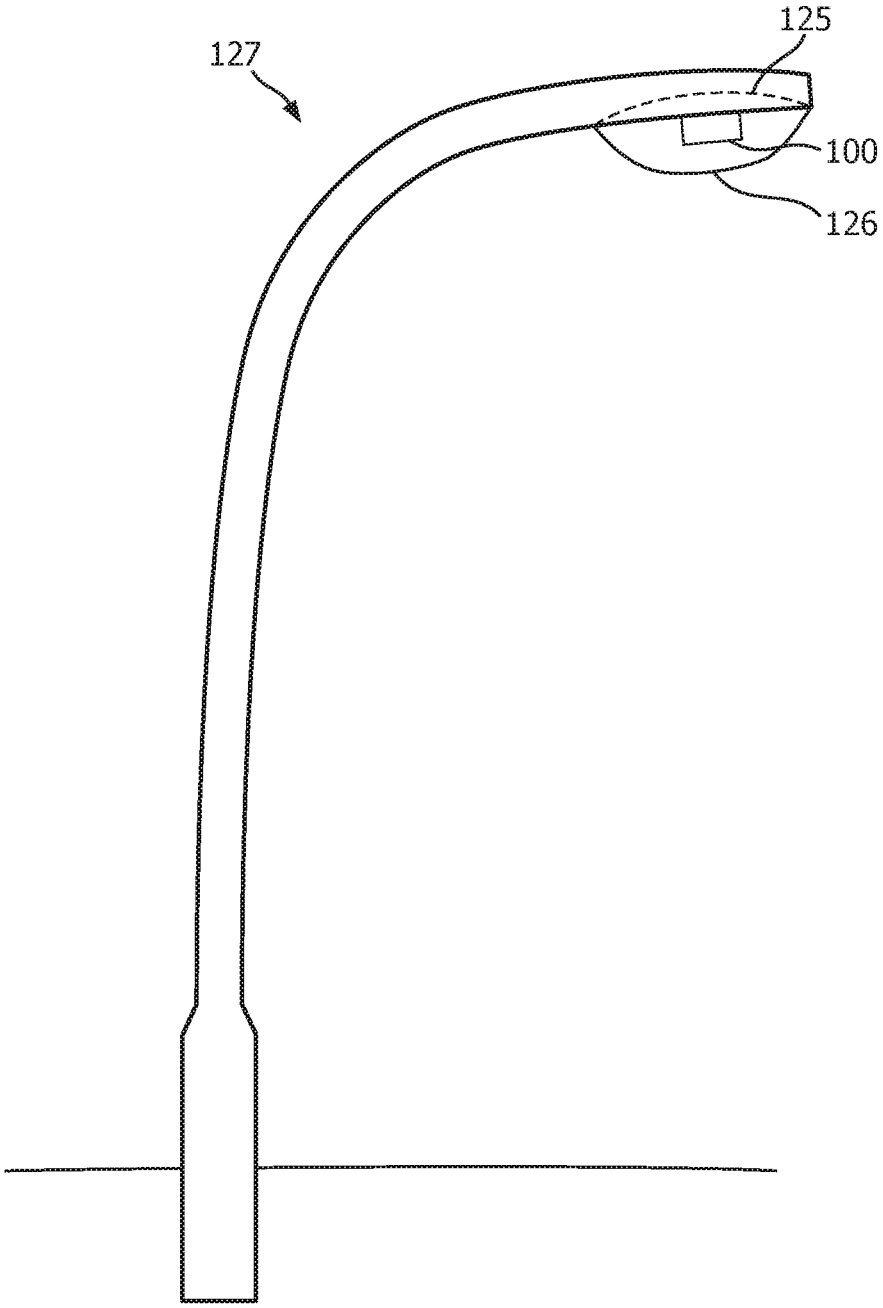

FIG. 6 schematically depicts the use of the lighting module 100 in a luminaire 127. The lighting module 100 is positioned in a luminaire 127. The luminaire 127 comprises a reflector 125 being positioned for reflecting the first light 103 of the first light source 101 (not shown). Second light is directly exiting the exit window 126 of the luminaire 127. The obtained effect is that the first light distribution 105 is at least partly overlapping the second light distribution 106. Preferably, the overlap of the first light distribution 105 and the second light distribution 106 is maximal.

The term luminaire may define a fixture or any other device for holding a lamp, and optionally a reflector.

For example, when the lighting module 100 is applied in a streetlamp it provides high lumen-output and high utilization of the light which, and it enables to replace a conventional high pressure sodium lamp without modification of the associated luminaire.

The light source may be a solid state light emitter. Examples of solid state light emitters are Light Emitting Diodes (LEDs), Organic Light Emitting diode(s) OLEDs, or, for example, laser diodes. Solid state light emitters are relatively cost effective, have a relatively large efficiency and a long life-time. The LED light source may be a phosphor converted LED (a LED comprising a luminescent material) or a colored LED (a LED not comprising a luminescent material). The luminescent material is arranged for converting at least part of the light emitted by the LED into light of a longer wavelength. The luminescent material may be an organic phosphor, an inorganic phosphor and/or a quantum dot based material.

The lighting module 100 may be configured to provide white light. The term white light herein, is known to the person skilled in the art and relates to white light having a correlated color temperature (CCT) between about 2,000 K and 20,000 K. In an embodiment the CCT is between 2,500 K and 10,000K. Usually, for general lighting, the CCT is in the range of about 2700K to 6500K. Preferably, it relates to white light having a color point within about 15, 10 or 5 SDCM (standard deviation of color matching) from the BBL (black body locus). Preferably, it relates to white light having a color rendering index (CRI) of at least 70 to 75, for general lighting at least 80 to 85.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting module for use in a reflector, comprising:

at least one first light source configured to emit first light having a first light distribution with a first main direction, at least one second light source configured to emit second light having a second light distribution with a second main direction opposite to the first main direction, a base for connecting the lighting module to a luminaire socket and having a longitudinal axis extending through a center thereof, the first light source being positioned on the longitudinal axis and the second light source being positioned at a non-zero distance to the longitudinal axis, wherein the first main direction and the second main direction are substantially perpendicular with respect to the longitudinal axis, and a carrier for carrying said first light source and said second light source, wherein the carrier is attached to said base and comprises a rotation mechanism for rotating the first light source and the second light source with respect to the longitudinal axis, wherein the first light source is kept on the longitudinal axis and wherein the base remains stationary relative the rotation of the first light source and the second light source.

2. The lighting module according to claim 1, wherein the carrier comprises a heat spreading member on which the first light source and the second light source are disposed.

3. The lighting module according to claim 2, wherein the heat spreading member has a first surface that carries said first light source and a second surface that carries said second light source, wherein a distance between the first light source and second light source defines a thickness T of the heat spreading member, the first surface and the second surface having a width W extending perpendicular to a direction of the longitudinal axis and perpendicular to a direction of the thickness T and wherein the thickness T is at least two times the width W.

4. The lighting module according to claim 3, wherein the thickness T is in the range from 5 mm to 100 mm.

5. The lighting module according to claim 3, wherein the width W is in the range from 1 mm to 30 mm.

6. The lighting module according to claim 1, wherein the lighting module comprises an at least partially light transmitting envelope enclosing at least the first light source and the second light source.

7. The lighting module according to claim 1, wherein the first light source comprises a plurality of light emitting diodes arranged in a first light emitting diode array extending in a direction of the longitudinal axis.

8. The lighting module according to claim 1, wherein the second light source comprises a plurality of light emitting diodes arranged in a second light emitting diode array extending in a direction of the longitudinal axis.

9. The lighting module according to claim 7, wherein the first light emitting diode array comprises at least a first light emitting diode row configured to emit first light emitting diode row light in a third main direction and at least a second light emitting diode row configured to emit second light emitting diode row light in a fourth main direction, wherein the combined first light emitting diode row light and the second light emitting diode row light provides the first light in the first main direction.

10. The lighting module according to claim 7, wherein the second light emitting diode array comprises at least a third light emitting diode row configured to emit third light emitting diode row light in a fifth main direction and at least a fourth light emitting diode row configured to emit sixth light emitting diode row light in a sixth main direction, wherein the combined third light emitting diode row light and fourth light emitting diode row light provides the second light in the second main direction.

11. The lighting module according to claim 10, wherein both an angle between the first light emitting diode row and the second light emitting diode row and an angle between the third light emitting diode row and the fourth light emitting diode row is in the range from 60 to 300 degrees.

12. The lighting module according to claim 1, wherein at least one of the first light source and the second light source comprises an optical element, wherein the optical element is positioned in an optical path of the first light or the second light and is configured for collimating the first light or the second light.

13. The lighting module according to claim 1, wherein the lighting module comprises a reflector positioned for reflecting the first light to obtain the first light distribution at least partly overlapping the second light distribution.

14. A luminaire comprising said lighting module according to claim 1, the reflector being positioned for reflecting the first light to obtain the first light distribution at least partly overlapping the second light distribution.

* * * * *